US007261068B1

(12) United States Patent
Wantschik

(10) Patent No.: US 7,261,068 B1
(45) Date of Patent: Aug. 28, 2007

(54) VEHICULAR THERMOSTATICALLY-CONTROLLED DUAL-CIRCUIT COOLING SYSTEM AND ASSOCIATED METHOD

(75) Inventor: Paul Alexander Wantschik, Platteville, WI (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 11/355,473

(22) Filed: Feb. 16, 2006

(51) Int. Cl.
*F01P 3/00* (2006.01)

(52) U.S. Cl. ..... 123/41.29; 165/148

(58) Field of Classification Search ..... 123/41.29, 123/41.33; 165/148
See application file for complete search history.

(56) References Cited

U.S. PATENT DOCUMENTS 4,049,047 A * 9/1977 Keen ..... 165/104.31
4,385,594 A * 5/1983 Hauser, Jr. ..... 123/41.29
4,535,729 A * 8/1985 Faylor ..... 123/41.1
5,215,044 A * 6/1993 Banzhaf et al. ..... 123/41.29
5,669,338 A * 9/1997 Pribble et al. ..... 123/41.29
5,899,266 A * 5/1999 Szucs ..... 165/110
6,098,576 A * 8/2000 Nowak et al. ..... 123/41.33
6,321,697 B1 * 11/2001 Matsuda et al. ..... 123/41.29
6,382,144 B1 * 5/2002 Schneider ..... 123/41.29
7,047,913 B2 * 5/2006 Werner et al. ..... 123/41.33
2006/0096555 A1 * 5/2006 Buck ..... 123/41.28
2006/0185626 A1 * 8/2006 Allen et al. ..... 123/41.12
2006/0213459 A1 * 9/2006 Theorell ..... 123/41.02

* cited by examiner

*Primary Examiner*—Stephen K. Cronin
*Assistant Examiner*—Katrina B. Harris

(57) ABSTRACT

A dual-circuit cooling system for a vehicle is disclosed. One of the circuits may be used to manage the temperature of the engine while the other circuit may be used to manage the temperature of a component other than the engine. An associated method is disclosed.

20 Claims, 6 Drawing Sheets

VEHICULAR THERMOSTATICALLY-CONTROLLED DUAL-CIRCUIT COOLING SYSTEM AND ASSOCIATED METHOD

FIELD OF THE DISCLOSURE

The present disclosure relates to cooling systems and, more particularly, to cooling systems for vehicles such as work vehicles.

BACKGROUND OF THE DISCLOSURE

The cooling system of a vehicle may be used to manage the temperature of one or more onboard component(s). For example, in the case of work vehicles, the cooling system may be used to cool or warm the engine, a charge air cooler, and/or an oil cooler.

SUMMARY OF THE DISCLOSURE

According to the present disclosure, a dual-circuit cooling system for a vehicle is comprises first and second fluid circuits. The first fluid circuit is used to manage the temperature of an engine of the vehicle. The second fluid circuit is fluidly coupled to the first fluid circuit for communication of coolant therebetween and comprises a radiator and a radiator bypass in parallel with the radiator for use in managing the temperature of a component of the vehicle other than the engine. An associated method is disclosed.

The above and other features will become apparent from the following description and the attached drawings.

BRIEF DESCRIPTION OF THE DRAWINGS

The detailed description particularly refers to the accompanying figures in which.

DETAILED DESCRIPTION OF THE DRAWINGS

Figure 1:
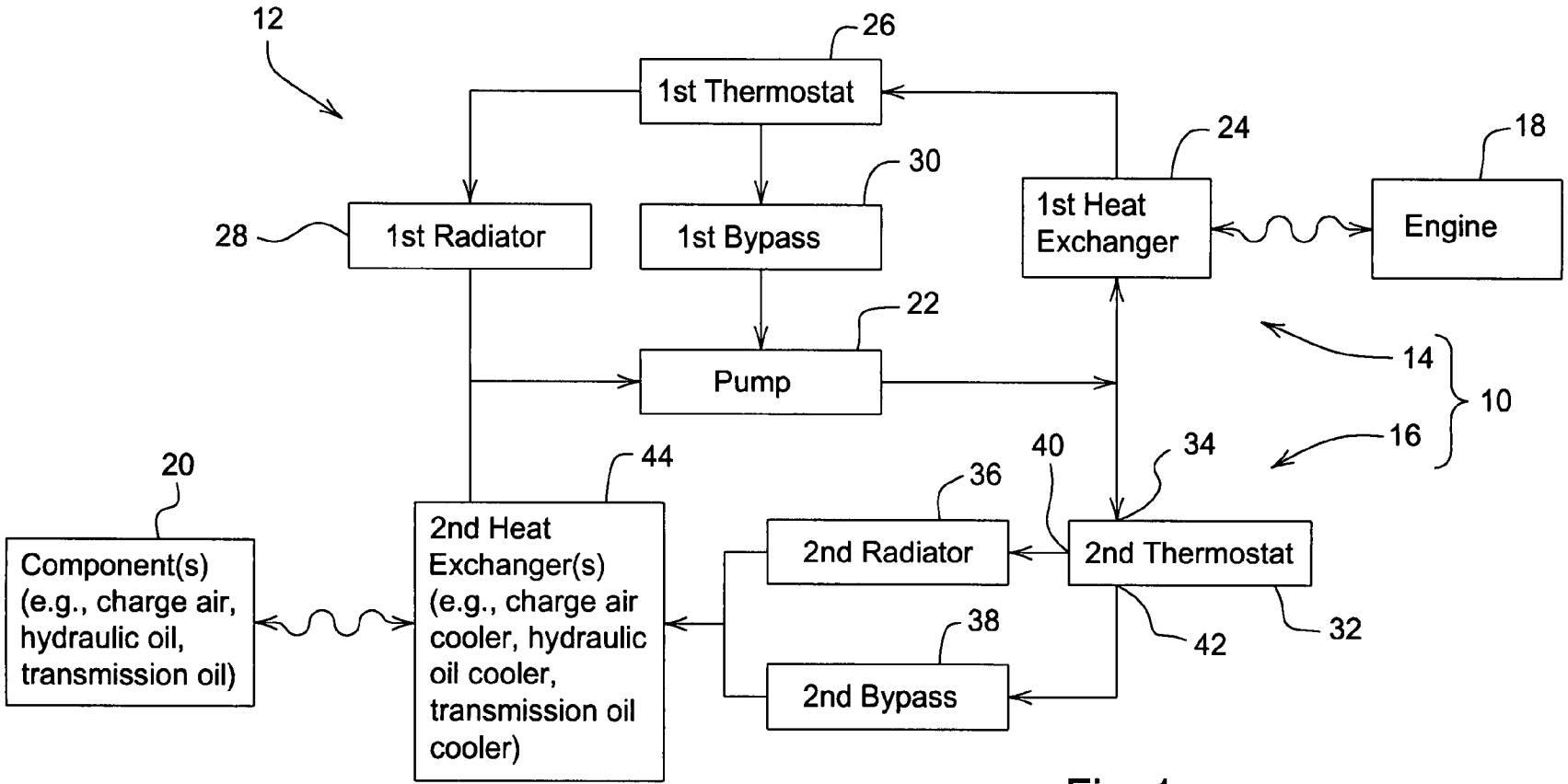
FIG. 1 is a diagrammatic view of a thermostatically-controlled dual-circuit cooling system of a vehicle.

Referring now to the FIG. 1, there is shown a thermostatically-controlled dual-circuit cooling system 10 of a vehicle 12 for thermally managing various components of the vehicle 12. The cooling system 10 has an endless loop first fluid circuit 14 and an endless loop second fluid circuit 16 fluidly coupled to the first fluid circuit 14. The circuit 14 is used to thermally manage an internal combustion engine 18 of the vehicle 12 while the circuit 16 is used to thermally manage one or more other component(s) 20 onboard the vehicle 12. The circuit 16 is configured in a manner so as to promote relatively quick warm-up of the component(s) 20 during cold-start conditions and to respond relatively quickly to transient heat loads of the engine 18, as discussed in more detail below.

Exemplarily, a pump 22 is integrated into both circuits 14, 16 so as to be in common therewith to pump coolant therethrough. As such, the circuits 14, 16 share a common supply of coolant. An expansion tank (not shown) may be included to receive coolant overflow from radiators of the circuits 14, 16.

The first fluid circuit 14 thermostatically manages the temperature of the engine 18. Coolant is advanced by the pump 22 to a first heat exchanger 24 associated with the engine 18. The exchanger 24 is, for example, a coolant jacket of the engine 18 that circulates coolant about the engine 18 to transfer heat between the engine 18 and the coolant either to cool or warm the engine 18.

Downstream from the exchanger 24 is a first thermostat 26 (e.g., thermostatic valve) which selectively directs coolant between a first radiator 28 ("high temperature radiator") and a first radiator bypass 30 parallel to the radiator 28 in response to temperature. When the coolant temperature is below a predetermined temperature, the thermostat 26 directs coolant through the first bypass 30 back to the pump 22 so that the coolant bypasses the first radiator 28, thereby promoting warm-up of the engine 18. At the predetermined temperature, the thermostat 26 starts to open to begin allowing flow of coolant to the first radiator 28 for transfer of heat away from the coolant to air flowing past the radiator 28, the flow of air resulting, for example, from operation of an onboard cooling fan and/or movement of the vehicle 12 along the ground. With increasing coolant temperature, the thermostat 26 opens more and more such that all, or at least a substantial amount, of the coolant flows to the radiator 28 for subsequent cooling of the engine 18. The pump 22 receives coolant flow from the bypass 30 and/or the radiator 28 to begin the cycle anew.

A portion of the coolant pressurized by the pump 22 is introduced into the second fluid circuit 16. Such coolant flows to a second thermostat 32 (e.g., thermostatic valve) of the circuit 16. An inlet port 34 of the thermostat 32 is fluidly coupled to the pump 22 to receive coolant therefrom. The thermostat 32 selectively directs coolant between a second radiator 36 ("low temperature radiator") and a second radiator bypass 38 in parallel with the second radiator 36 in response to temperature. As such, the thermostat 32 has a first outlet 40 fluidly coupled to the radiator 36 to discharge coolant thereto and a second outlet 42 fluidly coupled to the radiator bypass 38 for discharge of coolant thereto. The thermostat 32 is thus positioned fluidly between the pump 22 and the radiator 36 and between the pump 22 and the bypass 38.

The thermostat 32 is configured so as to direct coolant to the bypass 38 when the coolant temperature is below a predetermined temperature (e.g., 60° C.). In such a case, all or at least a substantial amount of the coolant flows through the bypass 38 to one or more heat exchangers 44, thereby bypassing the radiator 36. This is useful during cold-start conditions when the component(s) 20 in thermal communication with the exchanger(s) 44 are relatively cold. Use of the bypass 38 thus enables relatively quick warming of the component(s) 20 at times when such warming is needed, thereby enhancing the performance of the vehicle 12.

At the predetermined temperature, the thermostat 32 starts to open to begin allowing coolant to flow to the exchanger(s) via the radiator 36. Coolant flowing through the radiator 36 is cooled due to transfer of heat from the coolant to air flowing past the radiator 36. The radiator 36 may be stacked in front of or behind the radiator 28 to benefit from air flow resulting from operation of the onboard cooling fan and/or movement of the vehicle 12. With increasing temperature at the thermostat 32, the thermostat continues to open allowing more coolant to flow through the radiator 36 to the exchanger(s) 44. The thermostat 32 may be configured such that eventually most, if not all, of the coolant in the circuit 16 flows through the radiator 36.

Coolant discharged from the radiator 36 and the bypass 38 flows to the one or more exchangers 44. Exemplarily, the exchanger(s) 44 may include, but is(are) not limited to, one or more charge air coolers for cooling engine intake air charged by a turbocharger ("charge air"), one or more hydraulic oil coolers, and/or a transmission oil cooler. As such, the component(s) may include, but is(are) not limited to, charge air, hydraulic oil for hydraulic functions onboard the vehicle 12, and/or transmission oil for a transmission onboard the vehicle 12. After passing through the exchanger (s) 44, coolant flows back to the pump 22. Illustrative embodiments of the exchanger(s) 44 are shown in FIGS. 2-5 discussed below.

In the circuit 16, coolant is always able to flow to the exchanger(s) 44 during operation of the vehicle 12 regardless of temperature, either through the bypass 38, the radiator 36, or both. This enables the circuit 16 to respond relatively quickly to instantaneous heat loads of the component(s) 20 at one or more of the exchanger(s) 44 (e.g., charge air cooler, hydraulic oil cooler, transmission oil cooler) to cool such heat loads relatively quickly, thereby enhancing the performance of the vehicle 12. This is in contrast to possible arrangements where there is not a bypass 38 such that the transient response of the system 10 to the heat loads is predominantly dependent on the temperature responsiveness of the thermostat 32 to allow passage of coolant through the radiator 36 to the exchanger(s) 44, resulting in a relatively slower reaction time to the head loads.

By fluidly connecting the first and second fluid circuits 14, 16 to one another via the single pump 22, coolant is able to flow between the circuits 14, 16. As a result, the radiator 28 of the circuit 14 is able to, in effect, add cooling capacity to the radiator 36 of the circuit 16, allowing for a smaller radiator 36 than in a situation where the circuits 14, 16 might be independent of one another. In addition, use of a single pump, as opposed to a pump for each circuit 14, 16, results in cost savings and promotes space economy.

Figure 2:
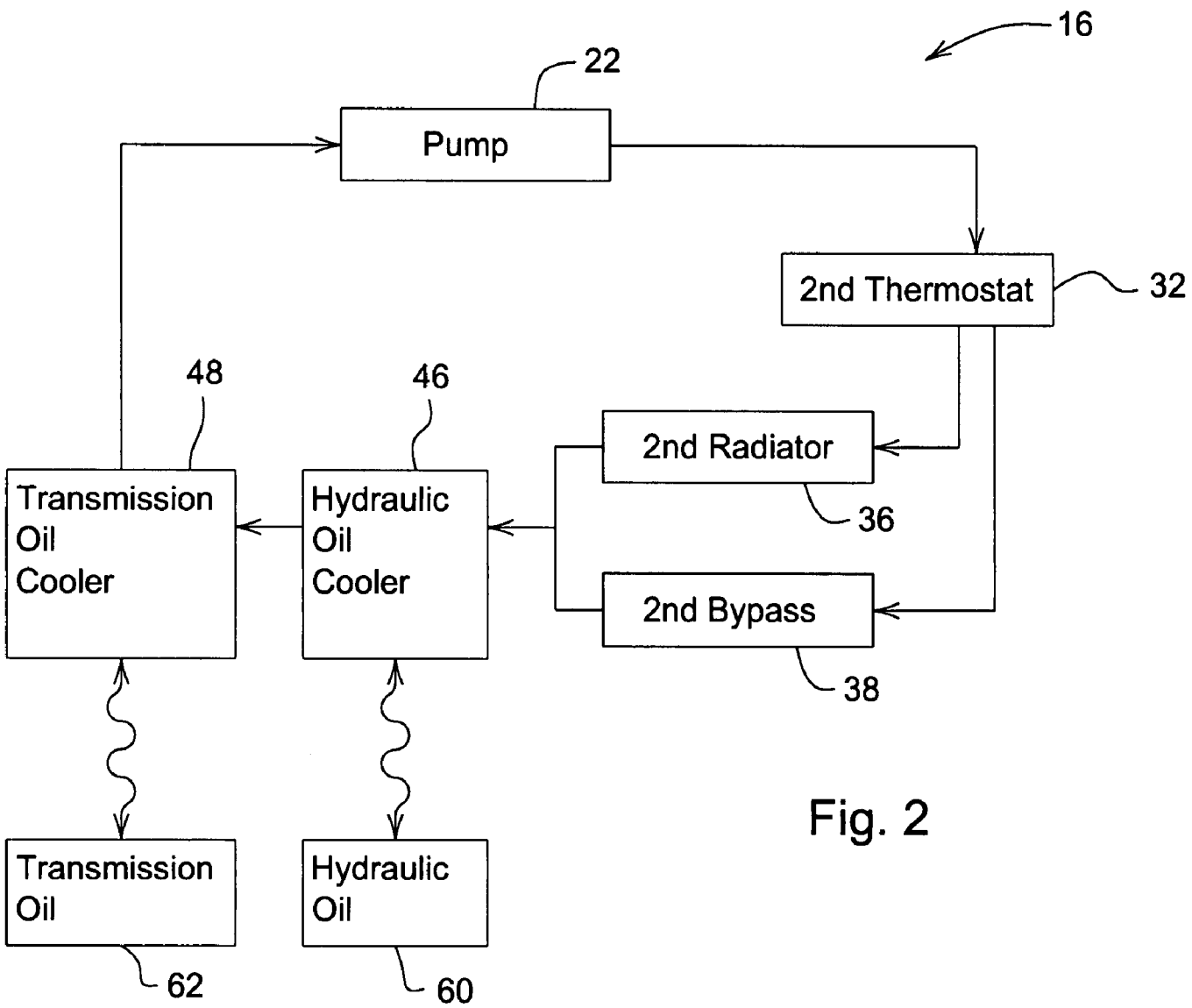
FIGS. 2-6 are diagrammatic views of various embodiments of a fluid circuit of the cooling system of FIG. 1.

Referring to FIG. 2, there is shown an exemplary embodiment of the second fluid circuit 16 in which a hydraulic oil cooler 46 for transferring heat with hydraulic oil 60 and a transmission oil cooler 48 for transferring heat with transmission oil 62 are in series with one another and are downstream from the radiator 36 and the bypass 38 to receive coolant therefrom as directed by the thermostat 32. Coolant is then conducted back to the pump 22.

Figure 3:
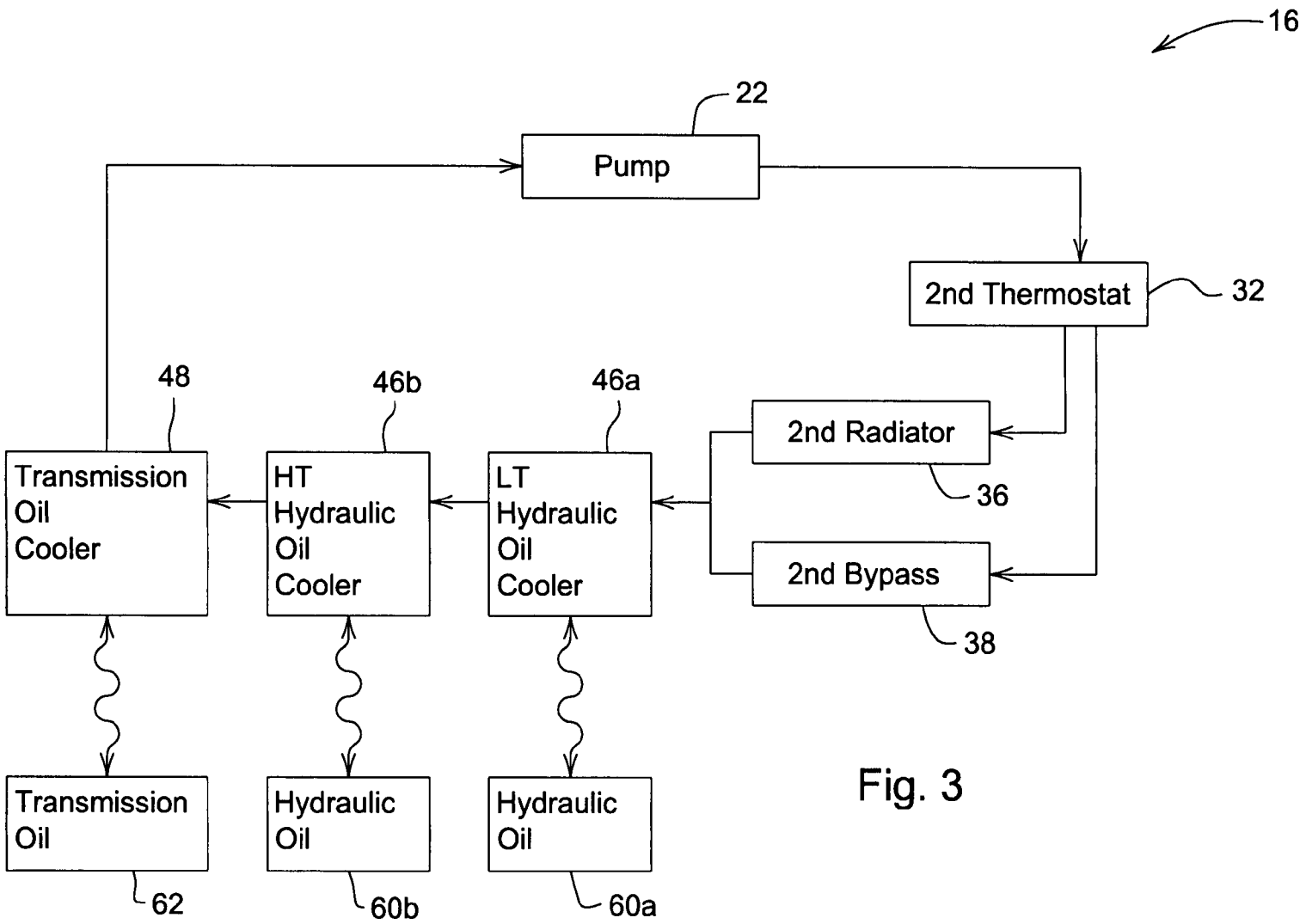

Referring to FIG. 3, there is shown an exemplary embodiment of the second fluid circuit 16 in which a low temperature hydraulic oil cooler 46*a* for transferring heat with hydraulic oil 60*a*, a high temperature hydraulic oil cooler 46*b* for transferring heat with hydraulic oil 60*b*, and a transmission oil cooler 48 are in series with one another. The coolers 46*a*, 46*b*, 48 are downstream from the radiator 36 and the bypass 38 to receive coolant therefrom as directed by the thermostat 32. Coolant is then conducted back to the pump 22.

Figure 4:
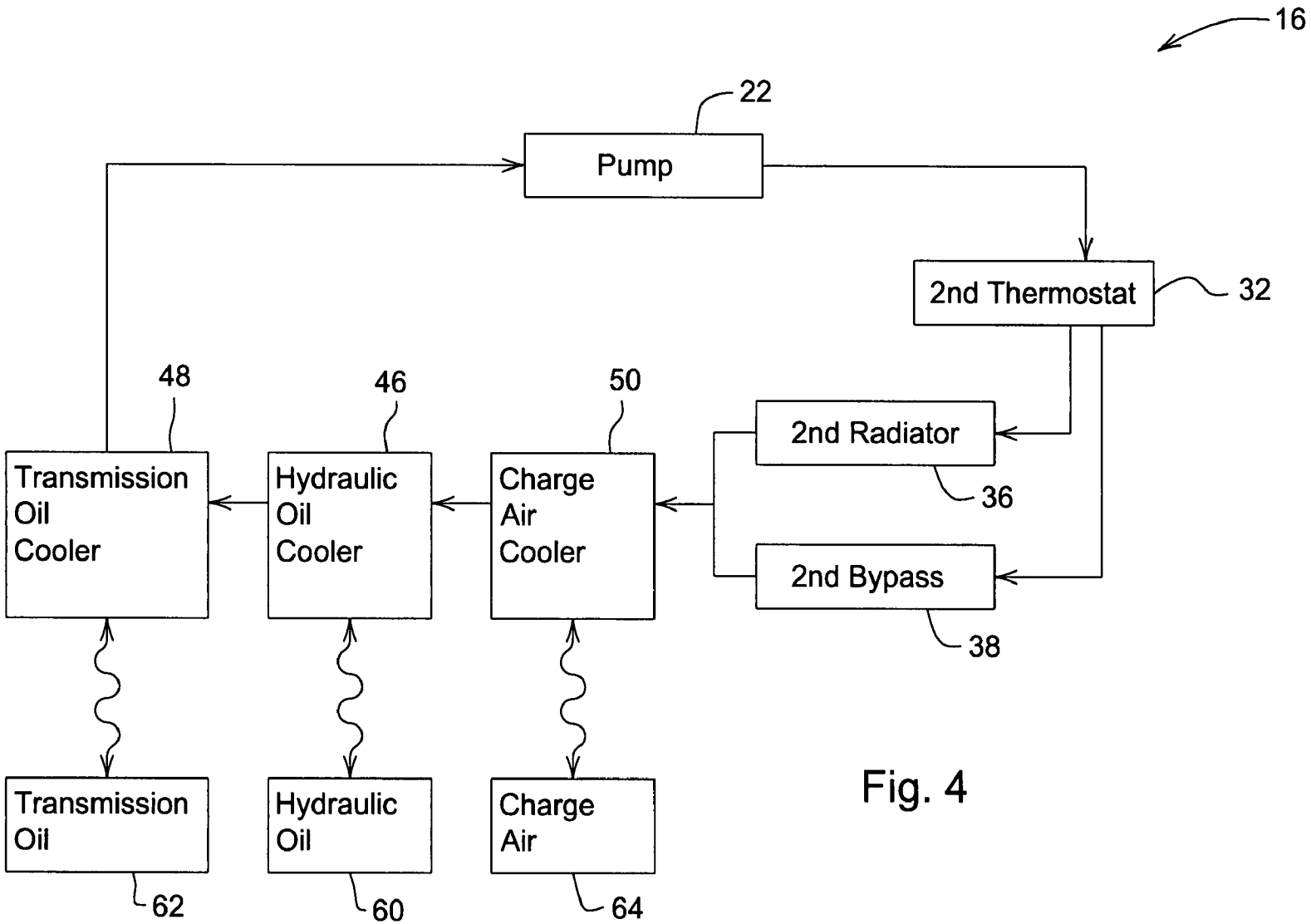

Referring to FIG. 4, there is shown an exemplary embodiment of the second fluid circuit 16 in which a charge air cooler 50 for transferring heat with charge air 64, a hydraulic oil cooler 46 for transferring heat with hydraulic oil 60, and a transmission oil cooler 48 for transferring heat with transmission oil 62 are in series with one another. The coolers 46, 48, 50 are downstream from the radiator 36 and the bypass 38 to receive coolant therefrom as directed by the thermostat 32. Coolant is then conducted back to the pump 22.

Figure 5:
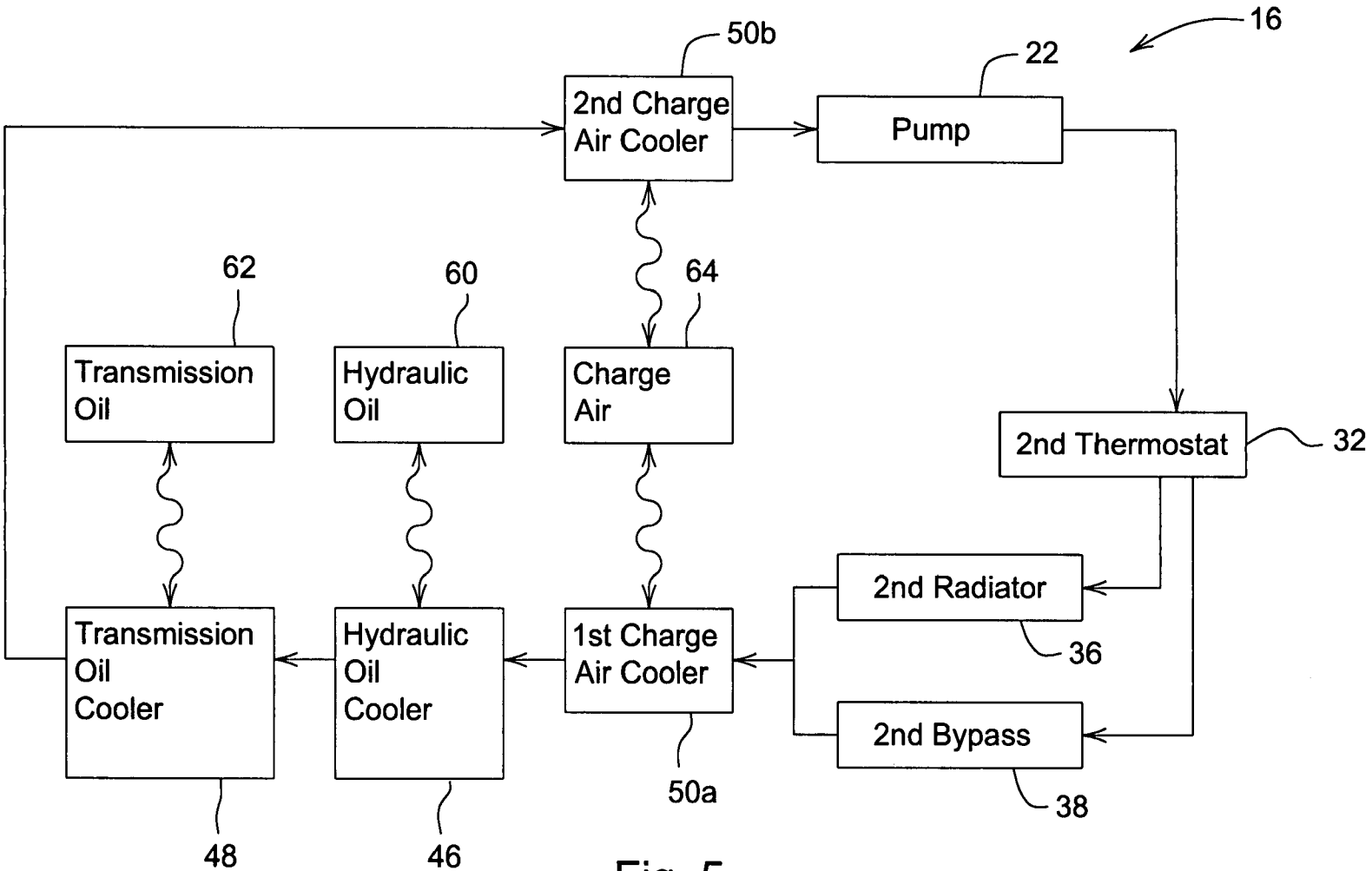

Referring to FIG. 5, there is shown an exemplary embodiment of the second fluid circuit 16 in which a first charge air cooler 50*a* for transferring heat with charge air 64, a hydraulic oil cooler 46 for transferring heat with hydraulic oil 60, a transmission oil cooler 48 for transferring heat with transmission oil 62, and a second charge air cooler 50*b* are in series with one another. The coolers 46, 48, 50*a*, 50*b* are downstream from the radiator 36 and the bypass 38 to receive coolant therefrom as directed by the thermostat 32. Coolant is then conducted back to the pump 22.

Figure 6:
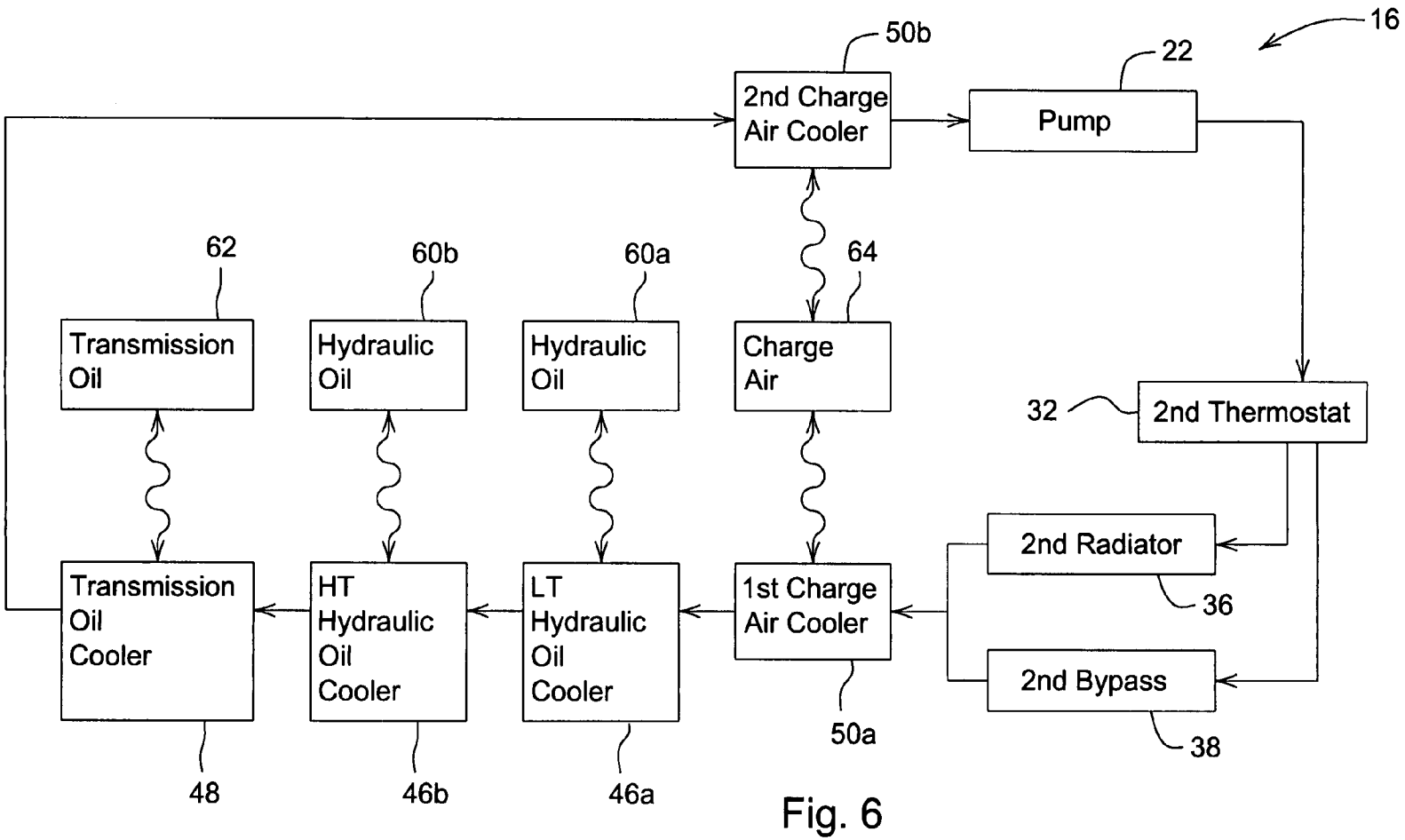

Referring to FIG. 6, there is shown an exemplary embodiment of the second fluid circuit 16 in which a first charge air cooler 50*a* for transferring heat with charge air 64, a low temperature hydraulic oil cooler 46*a* for transferring heat with hydraulic oil 60*a*, a high temperature hydraulic oil cooler 46*b* for transferring heat with hydraulic oil 60*b*, a transmission oil cooler 48 for transferring heat with transmission oil 48, and a second charge air cooler 50*b* for transferring heat with charge air 64 are in series with one another. The coolers 46*a*, 46*b*, 48, 50*a*, 50*b* are downstream from the radiator 36 and the bypass 38 to receive coolant therefrom as directed by the thermostat 32. Coolant is then conducted back to the pump 22.

The cooling system 10 may be used with a number of vehicles including, but not limited to work vehicles. Examples of such work vehicles for which the cooling system 10 may be especially useful include, but are not limited to, backhoes, loaders, excavators, motor graders, crawlers, and forestry vehicles, to name just a few.

While the disclosure has been illustrated and described in detail in the drawings and foregoing description, such an illustration and description is to be considered as exemplary and not restrictive in character, it being understood that illustrative embodiments have been shown and described and that all changes and modifications that come within the spirit of the disclosure are desired to be protected. It will be noted that alternative embodiments of the present disclosure may not include all of the features described yet still benefit from at least some of the advantages of such features. Those of ordinary skill in the art may readily device their own implementations that incorporate one or more of the features of the present disclosure and fall within the spirit and scope of the present invention as defined by the appended claims.

The invention claimed is:

1. A dual-circuit cooling system for a vehicle, comprising:

an endless loop first fluid circuit, an endless loop second fluid circuit, and a pump integrated into both the first fluid circuit and the second fluid circuit so as to be in common therewith to pump coolant therethrough, the pump situated such that the first fluid circuit is fluidly parallel to the second fluid circuit, the first fluid circuit comprising a first radiator, a first radiator bypass in parallel with the first radiator, a first heat exchanger positioned to receive coolant from the first radiator and the first radiator bypass and associated with an engine of the vehicle for transferring heat between the engine and the first heat exchanger, the pump, and a first thermostat for selectively directing coolant between the first radiator and the first radiator bypass in response to temperature, and the second fluid circuit comprising a second radiator, a second radiator bypass in parallel with the second radiator, a second heat exchanger positioned to receive coolant from the second radiator and the second radiator bypass and associated with a component of the vehicle other than the engine for transferring heat between the component and the second heat exchanger, the pump, and a second thermostat for selectively directing coolant between the second radiator and the second radiator bypass in response to temperature.

2. The dual-circuit cooling system of claim 1, wherein the second thermostat directs coolant to the second radiator bypass in response to temperatures below a predetermined temperature and directs coolant to the second radiator in response to temperatures above the predetermined temperature.

3. The dual-circuit cooling system of claim 1, wherein the second thermostat is positioned fluidly between the pump and the second radiator and between the pump and the second radiator bypass.

4. The dual-circuit cooling system of claim 1, wherein the second heat exchanger comprises a charge air cooler such that the second thermostat controls flow of coolant to the charge air cooler via the second radiator and the second radiator bypass.

5. The dual-circuit cooling system of claim 1, wherein the second heat exchanger comprises a hydraulic oil cooler such that the second thermostat controls flow of coolant to the hydraulic oil cooler via the second radiator and the second radiator bypass.

6. The dual-circuit cooling system of claim 1, wherein the second heat exchanger comprises a transmission oil cooler such that the second thermostat controls flow of coolant to the transmission oil cooler via the second radiator and the second radiator bypass.

7. A dual-circuit cooling system for a vehicle, comprising:

a first fluid circuit for managing the temperature of an engine of the vehicle, a second fluid circuit fluidly coupled to the first fluid circuit and comprising a radiator and a radiator bypass in parallel with the radiator for use in managing the temperature of a component of the vehicle other than the engine, and a pump integrated into both the first fluid circuit and the second fluid circuit so as to be in common therewith to pump coolant common to both the first fluid circuit and the second fluid circuit therethrough, the pump situated such that the first fluid circuit is fluidly parallel to the second fluid circuit.

8. The dual-circuit cooling system of claim 7, wherein the second fluid circuit comprises a thermostat for selectively directing flow of coolant between the second radiator and the radiator bypass in response to temperature.

9. The dual-circuit cooling system of claim 8, wherein the thermostat directs coolant to the radiator bypass in response to temperatures below a predetermined temperature and directs coolant to the radiator in response to temperatures above the predetermined temperature.

10. The dual-circuit cooling system of claim 8, wherein the thermostat comprises a first outlet fluidly coupled to the radiator and a second outlet fluidly coupled to the radiator bypass.

11. The dual-circuit cooling system of claim 8, wherein:

a pump is fluidly coupled to both the first fluid circuit and the second fluid circuit to pump coolant therethrough, and the thermostat comprises an inlet fluidly coupled to the pump, a first outlet fluidly coupled to the radiator, and a second outlet fluidly coupled to the radiator bypass.

12. The dual-circuit cooling system of claim 7, wherein:

the second fluid circuit comprises a charge air cooler for cooling air supplied to the engine of the vehicle, and the charge air cooler is positioned to receive coolant from the radiator and the radiator bypass.

13. The dual-circuit cooling system of claim 7, wherein:

the second fluid circuit comprises a hydraulic oil cooler for cooling hydraulic oil of the vehicle, and the hydraulic oil cooler is positioned to receive coolant from the radiator and the radiator bypass.

14. The dual-circuit cooling system of claim 7, wherein:

the second fluid circuit comprises a transmission oil cooler for cooling transmission oil of the vehicle, and the transmission oil cooler is positioned to receive coolant from the radiator and the radiator bypass.

15. The dual-circuit cooling system of claim 7, wherein the dual-circuit cooling system is onboard the vehicle.

16. A method of operating a dual-circuit cooling system of a vehicle, the dual-circuit cooling system comprising an endless loop first fluid circuit an endless loop second fluid circuit, and a pump integrated into both the first fluid circuit and the second fluid circuit so as to be in common therewith, the pump situated such that the first fluid circuit is fluidly parallel to the second fluid circuit, the method comprising:

thermostatically managing the temperature of an engine of the vehicle by use of the first fluid circuit, advancing coolant between the first fluid circuit and the second fluid circuit by use of the pump, and thermostatically managing the temperature of a component of the vehicle other than the engine by use of the second fluid circuit, the second fluid circuit comprising a radiator and a radiator bypass in parallel with the radiator, wherein the thermostatically managing the temperature of the component comprises selectively directing coolant common to both the first fluid circuit and the second fluid circuit between the radiator and the radiator bypass in response to temperature.

17. The method of claim 16, wherein the selectively directing comprises advancing coolant through the bypass to the component.

18. The method of claim 16, wherein the selectively directing comprises advancing coolant simultaneously through the bypass and the radiator to the component.

19. The method of claim 16, wherein the selectively directing comprises advancing coolant through the radiator, but not the radiator bypass, to the component.

20. The method of claim 16, wherein:

the radiator and the radiator bypass are part of a parallel flow arrangement, and the thermostatically managing the temperature of the component comprises advancing coolant from the parallel arrangement to a charge air cooler, a hydraulic oil cooler, and at least one of a transmission and an oil cooler.

* * * * *